United States Patent [19]

Kotter et al.

[11] 4,028,872

[45] June 14, 1977

[54] METHOD AND APPARATUS FOR PRODUCING YARN FROM FIBROUS TUFTS

[75] Inventors: James I. Kotter, Mandeville; Craig L. Folk, New Orleans, both of La.

[73] Assignee: The United States of America as represented by the Secretary of Agriculture, Washington, D.C.

[22] Filed: Apr. 30, 1976

[21] Appl. No.: 681,961

[52] U.S. Cl. ..... 57/58.91; 57/34 R; 57/50; 19/105; 19/145.5

[51] Int. Cl.[2] ..... D01H 1/12; D01G 15/00; D01G 21/00

[58] Field of Search ..... 57/1, 2, 34 R, 50, 58.89, 57/58.91, 156; 19/105, 145.5, 145.7

[56] References Cited

UNITED STATES PATENTS

| | | | |
|---|---|---|---|
| 3,130,535 | 4/1964 | Royster | 57/50 X |
| 3,443,372 | 5/1969 | Eddleston | 57/58.89 |
| 3,478,506 | 11/1969 | Kawashima | 57/50 X |
| 3,562,866 | 2/1971 | Roberson et al. | 19/105 X |
| 3,667,087 | 6/1972 | Dakin et al. | 19/105 |

*Primary Examiner*—Donald Watkins
*Attorney, Agent, or Firm*—M. Howard Silverstein; Salvador J. Cangemi; David G. McConnell

[57] ABSTRACT

By combination and interaction of mechanical and aerodynamic forces, textile fibers in the form of tufts are processed continuously by deposition into a hopper, subjected to an initial tuft-opening and cleaning apparatus, discharged as smaller tufts into another hopper wherein a constant level is maintained. The smaller tufts are then continuously formed into a lap and fed to a secondary opening and cleaning apparatus. Fibrous stock is pneumatically doffed and conveyed from this single source through a blending, subdividing and distributing means, in equal amounts through conduits to multiple remote locations for continuous assemblage into identical fibrous ribbons, fed to fiber individualizing means and subsequently to open-end spinning units for further processing into yarn.

9 Claims, 1 Drawing Figure

METHOD AND APPARATUS FOR PRODUCING YARN FROM FIBROUS TUFTS

BACKGROUND OF THE INVENTION

This invention relates to a method and apparatus for processing textile fibers from tufts into multiple strands of yarn within a single machine.

More specifically, the invention relates to a method and apparatus for processing textile fibers from relatively large tufts, continuously deposited into a hopper, processed through an initial tuft-opening and cleaning apparatus, discharged as smaller tufts into another hopper wherein a constant level of tufts is maintained, said smaller tufts continuously formed into a lap by a converging belt, lap making apparatus, said lap fed into a secondary opening and cleaning apparatus wherein it is converted to very fine tufts and fibers which are vacuum doffed from said apparatus and conveyed through a transitional duct (equipped with fiber disbursing means) into a fiber blending, subdividing, and distributing apparatus, whereby said fibers are equally divided and transported through a network of conduit to a multiplicity of condensers wherein said fibers are separated from the airstream and assembled into identical ribbons, said ribbons are fed to fiber individualizing means and subsequently to open-end spinners, producing yarn.

To those experienced in the art of textile processing, it is known that conventional methods of yarn production consists of many separate preparatory steps resulting in a non-continuous flow of fibers from initial opening to spinning, in distinctive strand formations, for example: card, first and second drawn and combed sliver, roving, etcetra, requiring numerous intricately designed machines, considerable labor, and a great expance of textile mill floor area.

Presently, there is no existing commercial method and apparatus for continuously processing textile fibers from tufts into multiple strands of yarn within a single machine.

SUMMARY AND OBJECTS OF THE INVENTION

The principal object of this invention is to simplify textile processing by eliminating the carding drawing and roving processes without sacrificing yarn quality.

Another object of this invention is to eliminate intermediate, containerizing and manual handling of fibers in various forms from one processing step to another.

Another object of this invention is to provide integral means for continuously opening, cleaning and transforming relatively large tufts into small tufts and providing means to insure the formation of a uniform fibrous lap.

Another object of this invention is to provide a continuous means for processing the lap into clean well-opened or separated fibers.

Another object of this invention is to provide an automatic means for distributing equal amounts of fibers from lap processing means to multiple locations for assembly into identical ribbons.

Another object of this invention is to provide a means for continuously producing uniform identical ribbons and supplying them into a fiber individualizing means.

Another object of this invention is to provide a means for continuous pneumatic disbursing and feeding individualized fibers peripherally into an open-end spinning unit.

Another object of this invention is to utilize an open-end spinning apparatus capable of receiving individualized fibers peripherally and transforming them into an acceptable yarn.

Other objects and advantages of this invention will further become apparent hereinafter and in the drawings.

This invention employs a unique method of processing fibers from tufts into yarn by integral steps of non-interrupted flow.

Tufts from blending hopper feeders or the like are supplied to a vertical chute or hopper separated from a vertical lower chute by an initial opening apparatus which transforms the relatively large tufts weighing 0.5 to 1.5 grams into small tufts of 0.03 to 0.04 grams. Ths apparatus for opening the tufts is composed of a resilient feed cylinder that oscillates as it rotates and a processing cylinder with retractable teeth. The processing cylinder is self doffing and generates a negligable volute of air during operation, thereby eliminating turbulence and permitting the tufts to gently fall and settle in the lower chute uninfluenced by external forces other than gravity. The transverse reciprocating motion of the feed cylinder prevents grooving of the feed stock as it is being fed to the processing cylinder thereby enhancing feed uniformity.

As large tufts are opened and reduced to a smaller size, trash is separated from the fibers and removed by means of a grid. A trash collection chamber encasing the grid is installed adjacent to the opening area.

To insure non-varying tuft density in the lower chute, a desirable tuft height is maintained by an electronic sensor which controls the opening feed cylinder in an "on-off" mode of operation.

Tufts in the lower chute are supported by converging conveyor belts, integral parts of a low-force lap forming apparatus that transforms the lower chute tuft column into a continuous fibrous mass that resembles a standard picker lap. The theory of operation involves compression of the tufts between two belts traveling at the same speed, with a small displacement of one belt as it moves in relation to the other. The movement of the belts in compression, combined with the oscillation of a roller, kneads the fibers interlocking them into a compact mass.

The newly formed lap is continuously drawn into a licker-in type intermediate opener by the action of its resilient covered feed roller in close proximity with a feed plate. By the action of the opener, the lap is converted into extreemly fine tufts which are cleaned and pneumatically doffed from the lickerin processing cylinder. The doffer, consisting of a suction nozzle incorporated into a duct, changes from a slotted inlet the width of the cylinder, to a round outlet. The transitional duct is equipped with multiple adjustable baffles maintaining an equal air velocity gradient across the duct to uniformly disperse the fibers into a distributor. The round outlet opening serves both as a journal and a pneumatic seal for a rotating entrance tube of the fiber distributor. The entrance tube is longitudinally slotted, dispersing fibers into a cylindrical chamber, where they are blended and subdivided into multiple outlets. Under negative air pressure, the fibers are pneumatically transported from the distributor outlets through tubes to a multiplicity of mini-condensers.

Within each condenser the fibers are separated from the airstream and collected on an inclined grid surface. The air flows through the condenser grid openings into a common manifold which is connected to a filter and suction source. Distribution of fibers to the mini-condensers is controlled by negative air pressure within each condenser. Variations in amount of fiber delivered to the condensers is less than 5%.

A rotating take-out cylinder, peripherally covered with resilient material, contacts each condenser forming a pneumatic seal. The takeout cylinder rotating at constant speed in close proximity to the terminal end of the grid, withdraws the fibers from the confines of the condenser in the form of a continuous fibrous ribbon. A curved deflection plate guides the ribbon as it moves from the take-out cylinder to a toothed feed cylinder of a spiral card assembly.

The negative rake toothed feed cylinder, clothed with metallic card doffer wire, performs dual functions serving as a feeder as well as a worker roller for the spiral card. Satisfactory operational results were obtained by rotating the feed cylinder in either direction. The preferred rotational direction, however, is clockwise at approximately 40 to 60 times faster then the resilient take-out cylinder. The spiral card processing cylinder is clothed with positive rake, metallic card cylinder wire and rotates at high rpm (4,000 to 8,000 rpm).

To eliminate the need for suction or other doffing means and provide positive control of the number of carding cycles, the top half of the card cover is provided with four spiral groves. With the card cylinder rotating at self-stripping speed the fibers are compelled by the grooves to spirally encircle the cylinder as they traverse the 5 cm distance from entrance to exit. Carding action takes place between the processing and the worker cylinders. An exit opening is provided in the housing terminal groove to permit discharge of fibers in a low volume airstream created by the rotating cylinder.

Individualized fibers exiting from the spiral card are aerodynamically transported across a smooth, truncated conic surface into the rotor of a Southern Regional Research Center designed open-end spinner. Utilizing the "Coanda Effect" (the phenomenon of a moving fluid adhering to a surface of a suitable shape), the fibers are distributed uniformly about the conic surface and accelerated circumferentially into the rotor's entrance perimeter.

Figure 1:
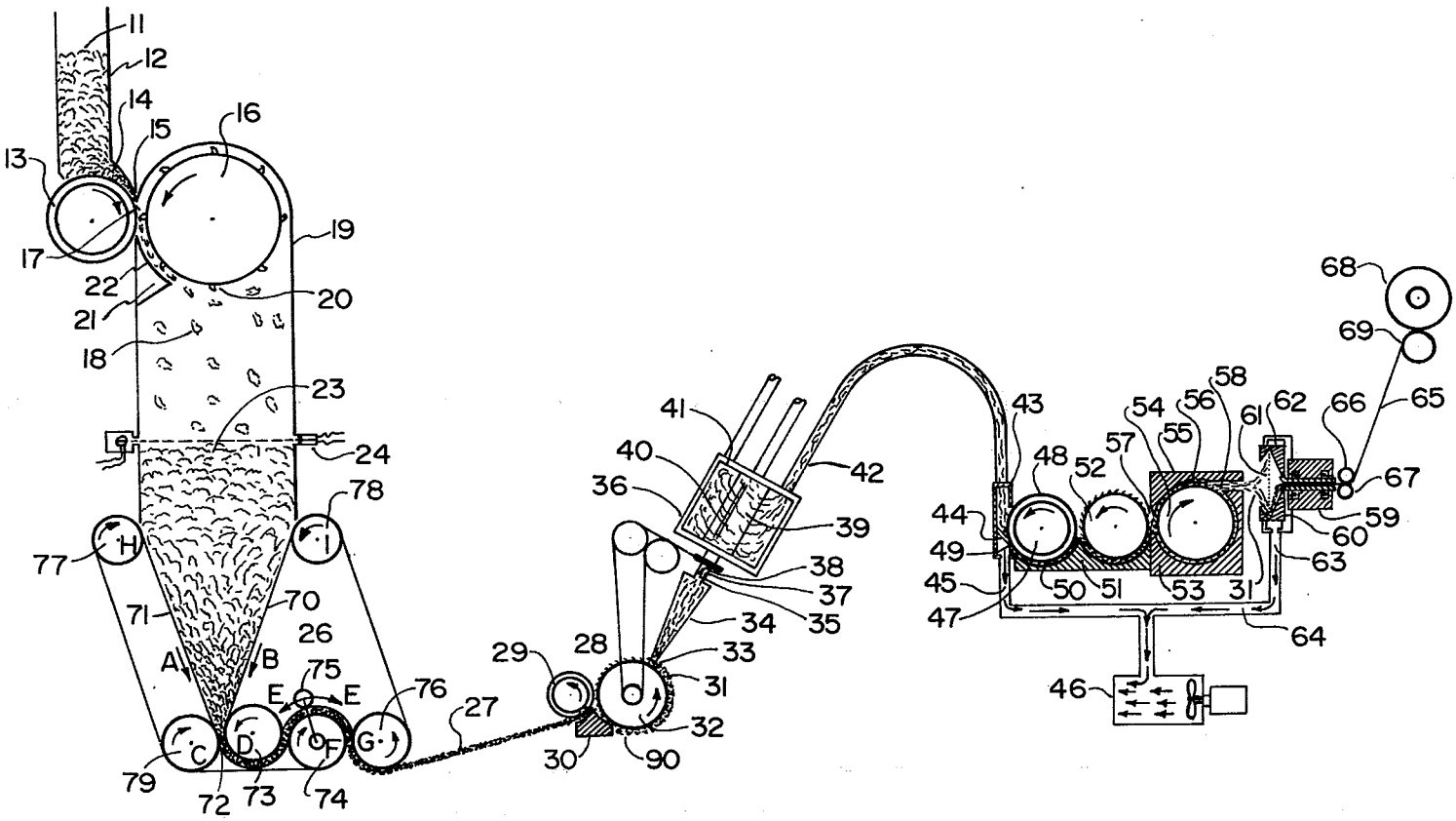
FIG. 1 is a schematic diagram (with portions in cross-section to show components and their interrelationships) of the invention depicting the flow of fiber from tufts to the formation of a multiplicity of yarns.

Referring to the single FIGURE 1, fibrous tufts 11 are deposited into vertical hopper 12. Tufts 11 form a column which is supported by resilient feed cylinder 13 which is driven at a constant speed in a clockwise direction when in the "on" mode of operation. As cylinder 13 rotates, tufts 11 are moved into transitional area 14 and subsequently under feed plate 15 which is in close proximity to feed cylinder 13. Between feed plate 15 and cylinder 13, fibrous mass 17 is formed and protrudes from feed plate 15. Retractable toothed processing cylinder 16, set at a minimum clearance distance from feed cylinder 13 and feed plate 15, rotates counter-clockwise at relatively higher surface speed than cylinder 13, and plucks from fibrous mass 17 thereby forming smaller tufts 18. Said tufts 18 are discharged into verticle chute 19 with a minimum of air generation by virtue of its retractable teeth 20.

As small tufts 18 are plucked from fibrous mass 17, foreign matter or trash (not shown) contained in fibrous mass 17 is dislodged and discharged by gravity and centrifugal force into trash collection chamber 21. Trash collection chamber 21 is constructed with curved bars (not shown) suitably spaced apart to form curved grid 22 across the peripheral face of trash collection chamber 21.

To insure a constant density of small tufts 18 in chute 19, a specific height of tufts 18 form a second tuft column 23, the density of which is maintained by electronic sensor 24, which controls the motor drive (not shown) of feed cylinder 13 in an on-off mode of operation.

Tufts in chute 19 are supported by converging conveyor belts 70 and 71, integral parts of low-force lap forming apparatus 26 that transforms tuft column 23 into continuous fibrous lap 27. Lap 27 is achieved by tuft column 23 being collected and transported on two converging moving belts 70 and 71 wherein the tufts are sandwiched between belts 70 and 71 at the point of intersection 72 forming a belt-lap-sandwich. Belts 70 and 71 move in the direction as indicated by arrows A and B. This belt-lap-sandwich take the following path: between fixed roller 79 and compression roller 73, then around the under periphery of compression roller 73 and between compression roller 73 and driving roller 74, then around and between the upper periphery of driving roller 74 and oscillating roller 75, then between driving roller 74 and compression roller 76, where the belt-lap-sandwich separates feeding lap 27 into licker-in type intermediate opener 28. Belt 71 then goes around the under periphery of drive roller 74, under and past compression roller 73, and under and around the under periphery of fixed roller 79, around and up to adjustable tension roller 77 where it feeds again back downward to the point of intersection. Belt 70 after leaving the point of separation from belt 71 follows around compression roller 76 up to adjustable tension roller 78 and down again to the point of intersection for a new cycle. During the course of travel through the rollers, the fiber and tufts are massaged into a tight compression forming lap 27. Fixed roller 79 turns in the direction indicated by arrow C, compression roller 73 in the direction indicated by arrow D, driving roller 74 in the direction of arrow F, oscillating roller 75 in the direction of E, compression roller 76 in the direction of G, adjustable tension roller 77 in the direction of H, and adjustable tension roller 78 in the direction of I. Lap 27 thus formed, is continuously drawn into licker-in type intermediate opener 28 by the action of resilient covered feed roll 29 in close proximity to feed plate 30. By the action of opener 28, lap 27 is converted into well opened fibers 31 which are cleaned at area 90 prior to pneumatically doffing from cylinder 32 at suction inlet 33 of transitional duct 34. Transitional duct 34 changes from slotted inlet 33 which is the width of cylinder 32, to a round outlet 35. Duct 34 is equipped with multiple adjustable baffles, (not shown), maintaining an equal air velocity gradient across the duct to uniformly disperse the fibers 31 into distributor 36. The round outlet 35 serves as journal 37 and pneumatic seal 38 for rotating entrance tube 39. Entrance tube 39 is longitudinally slotted dispersing fibers 31 into cylindrical chamber 40 where said fibers 31 are blended and subdivided into multiple outlets 41.

Under negative air pressure the fibers are transported from slotted inlet 33 through transitional duct 34, through rotating entrance tube 39, into cylindrical chamber 40 of distributor 36.

From multiple outlets 41 of chamber 40, the fibers 31 are air transported through tubes or conduits, 42 to a multiplicity of mini-condensers 43. Within each condenser 43, the fibers are separated from the air stream by means of grid 44. The air flows through the condenser grid 44 into common manifold 45 which is connected to a filter (not shown) and suction source 46. Distribution of fibers 31 to condensers 43 is controlled by negative air pressure within condensers 43.

Fibers 31 are removed from grid 44 of condenser 43 by rotating take out cylinder 47, peripherally covered with resilient material 48. Cylinder 47 forming a pneumatic seal with condenser 43, rotating at constant speed in close proximity to terminal end 49 of grid 44, withdraws fibers 31 from the confines of condenser 43 in the form of a continuous fibrous ribbon 50 as it moves from take-out cylinder 47 to toothed feed cylinder 52 of spiral card 53.

The toothed feed cylinder 52 performs dual functions serving as a feeder and a worker roller for spiral card 53. The spiral card processing cylinder 54 rotating at self-doffing speed is in close proximity with feed cylinder 52. Spiral card cover 55 is provided with four spiral grooves 56, with the card cylinder 54 rotating a self stripping speed fibers 31 which are compelled by grooves 56 to spirally encircle cylinder 54 as said fibers 31 traverse from entrance 57 to exit opening 58 incorporated within card cover 55.

Individualized fibers 31 exiting from the spiral card 53 are aerodynamically transported across a smooth, truncated conic deflector (not shown) into the rotor of SRRC designed open-end spinner 59. The fibers 31 are discharged onto the conic deflector (not shown) by positive airstream generated by card cylinder 54 and accelerated into open-end spinner rotor 60 by the influence of air under negative air pressure. Negative air pressure is generated by the action of centrifugal force and suction source 46 forcing air into rotor 60 and through peripheral holes 61 of rotor 60 into housing 62 of open-end spinner 59 and subsequently into manifold 63 and suction source 46 by means of interconnecting air handling conduit 64.

Fibers 31 are formed into yarn 65 within rotor 60. Yarn 65 is withdrawn from rotor 60 by means of take-out rollers 66 and 67 synchronously driven with winding means 68 and 69.

We claim:

1. A method for continuously producing yarn from fibrous tufts comprising in combination:

a. depositing textile fibers and tufts into a feeding means,
b. feeding said textile fibers and tufts through a transitional area and forming said textile fibers and tufts into a fibrous mass,
c. plucking said fibrous mass into smaller tufts and
d. discharging said smaller tufts of (c) into a verticle chute with a minimum of air generated by said plucking operation,
e. dislodging foreign matter and trash from the fibrous mass by said plucking operation of (c) and allowing said foreign matter and trash to discharge by gravity,
f. collecting said discharged foreign matter and trash in a collection chamber and
g. forming said tufts of (d) into a tuft column in the vertical chute of (d),
h. maintaining and controlling the density of said tuft column of (g) by means of electronic sensors which control an opening feed cylinder in an on-off mode of operation and thus controlling the tuft height and thus the density,
i. transforming said tuft column into a fiber lap by means of a low force lap forming apparatus,
j. drawing said fiber lap of (l) into a licker-in type intermediate opener, and
k. converting said fiber lap into well opened fibers, then
i. pneumatically cleaning said opened fibers, then
m. pneumatically doffing said cleaned fibers, and
n. feeding said doffed fibers through a transitional duct by means of balanced equal air velocity gradients across said duct and
o. uniformly dispersing said fibers into a distributor from which said fibers are distributed into a chamber,
p. blending said fibers in said chamber and then
q. subdividing said fibers into multiple outlets, then
r. transporting said fibers under negative air pressure through a rotating entrance tube into another cylindrical chamber,
s. transporting said fibers from multiple outlets of said cylindrical chamber of (*r*) into a multiplicity of mini-condensers wherein said fibers are separated from the air stream,
t. said air being exhausted through a common manifold, then filtered, and then exhausted through a suction source,
u. said fibers removed from said mini-condensers and
v. continuously assembled into identical fibrous ribbons, then
w. feeding to a fiber individualizing means and subsequently
x. feeding into an open end spinning unit for further processing.

2. The method of claim 1 wherein the textile fibers and tufts are formed into a column by the feeding means, said textile fiber and tuft column supported by a resilient feed cylinder rotating at a constant clockwise speed when in the on mode of operation.

3. The method of claim 1 wherein the fiber lap transformed in step (i) is massaged between two moving belts between a series of rotating rollers.

4. Apparatus for continuously producing yarn from fibrous tufts comprising in combination:

a. a means of forming textile fibers and tufts into a fibrous mass,
b. a means of plucking said fibrous mass from said textile forming means, thereby producing smaller tufts of fibrous material and separating foreign matter from said tufts,
c. a vertical chute with a minimum of air generated to receive and form small tufts into a verticle column of fiber tufts;
d. electronic sensors to maintain the density of said tufts of column (c) said sensors controlling a feed cylinder in an on-off mode of operation, thus controlling the tuft height and thus the density;
e. a low-force lap forming means to transform the column of fiber tufts of (c) into a lap;
f. a licker-in type intermediate opener means where said lap of (e) is drawn into and converted into opened fibers;

g. a pneumatic cleaning means to receive and clean the opened fibers of (f);

h. a pneumatic doffing means to doff said fibers of (g);

i. a transitional duct to feed said opened fibers by means of balanced equal air velocity gradients across said duct;

j. a distributing means to receive and equally disperse said fibers of (i);

k. a chamber to receive said dispersed fibers and wherein said fibers are blended and subdivided in said chamber;

l. said chamber comprising in combination a plurality of outlets to subdivide and equally disperse said fibers;

m. a multiplicity of mini-condensers to condense the fibers, said condenser comprising a means of separating the air stream from the fibers and allowing the air to be exhausted through a suction source;

n. an assembly means to assemble said fibers into identical fibrous ribbons;

o. open end spinners for further processing the ribbons into yarn.

5. The apparatus as defined in claim 4 wherein the means of forming textile fiber and tufts into a fibrous mass comprises a resilient feed cylinder driven in a clockwise direction at a constant speed.

6. The apparatus defined in claim 4 wherein the means of plucking the fibrous mass from the textile forming means comprises a rotating retractable toothed processing cylinder.

7. The apparatus as defined in claim 4 further comprising a plurality of tubes or conduits connecting said chamber outlets to said mini-condensers, said tubes or conduits functioning by means of positive internal air pressure.

8. The apparatus as defined in claim 7 wherein said tubes or conduits function by means of negative internal air pressure or air suction pressure.

9. The apparatus as defined in claim 4 wherein the condensers are equipped with a grid to intercept the fibers and said intercepted fibers are removed from the grid by a rotating take out cylinder.

* * * * *